US008730123B2

(12) United States Patent
Sugimoto et al.

(10) Patent No.: US 8,730,123 B2
(45) Date of Patent: May 20, 2014

(54) ANTENNA APPARATUS

(75) Inventors: Yuji Sugimoto, Kariya (JP); Tadao Suzuki, Kariya (JP); Ryohei Kataoka, Okazaki (JP); Miyuki Mizoguchi, Obu (JP)

(73) Assignees: Denso Corporation, Kariya (JP); Nippon Soken, Inc., Nishio (JP)

( * ) Notice: Subject to any disclaimer, the term of this patent is extended or adjusted under 35 U.S.C. 154(b) by 233 days.

(21) Appl. No.: 13/476,314

(22) Filed: May 21, 2012

(65) Prior Publication Data

US 2012/0299794 A1 Nov. 29, 2012

(30) Foreign Application Priority Data

May 27, 2011 (JP) ..... 2011-119370

(51) Int. Cl.
*H01Q 21/00* (2006.01)

(52) U.S. Cl.
USPC ..... 343/853; 343/711; 343/846

(58) Field of Classification Search
CPC ..... H01Q 1/32; H01Q 1/3275; H01Q 23/00; H01Q 1/48
USPC ..... 343/846, 848, 711, 713, 853
See application file for complete search history.

(56) References Cited

U.S. PATENT DOCUMENTS 6,549,169 B1 4/2003 Matsuyoshi et al.
2008/0248774 A1 10/2008 So et al.
2012/0319916 A1 * 12/2012 Gears et al. ..... 343/841

FOREIGN PATENT DOCUMENTS

JP 2008-205604 9/2008

* cited by examiner

*Primary Examiner* — Hoang V Nguyen
(74) *Attorney, Agent, or Firm* — Harness, Dickey & Pierce, PLC

(57) ABSTRACT

A wireless communication module is arranged such that a radio frequency circuit board stands vertically on a first earth plate. The radio frequency circuit board includes first and second radio frequency transmission and reception circuits at both end portions, respectively. The radio frequency circuit board includes a second earth plate serving as a grounding electric potential of the radio frequency transmission and reception circuits. Feed lines from the radio frequency transmission and reception circuits are connected to the first earth plate, respectively. Ground lines of the feed from the radio frequency transmission and reception circuits, respectively, are connected to the second earth plate. Thus, vertical exciting currents flow at both end portions of the second earth plane, enabling transmission and reception of vertical polarization waves.

6 Claims, 6 Drawing Sheets

ANTENNA APPARATUS

CROSS REFERENCE TO RELATED APPLICATION

This application is based on Japanese Patent Application No. 2011-119370 filed on May 27, 2011, the disclosure of which is incorporated herein by reference.

TECHNICAL FIELD

The present disclosure relates to an antenna apparatus mainly used for mobile communications.

BACKGROUND

[Patent document 1] JP 2008-205604 A

An antenna is mounted in a vehicle for executing various communications such as GPS, vehicle-to-vehicle communications, or road-to-vehicle communications. Such an antenna in a vehicle is required to enable downsizing and favorable transmission and reception performance.

Several wireless communication modules with antennas are provided for the several kinds of communications in a vehicle, respectively; the several wireless modules are required to be arranged collectively at the same place (for example, a predetermined place on the roof of the vehicle). Therefore, the various wireless communication modules with the antennas are required to achieve further downsizing.

To that end, Patent document 1 discloses a technology to downsize a wireless communication module with an antenna as follows. A radio frequency circuit board is mounted on a ground structure serving as a ground of a wireless terminal. A circuit board has a feed point at one end and a variable capacity reactive element at the other end. The feed point has one end connected with one end of a ground conductor of the circuit board and the other end connected with the ground structure via a first contact terminal. The variable capacity reactive element has one end connected with the other end of the ground conductor of the circuit board and the other end connected with the ground structure via a second contact terminal.

This forms a current loop that flows from the one end of the feed point, via the first the ground structure, the second contact terminal, the variable capacity reactive element, and the earth conductor, to the other end of the feed point. This configuration achieves a radiating pattern shape as an antenna without using an antenna element, thereby enabling downsizing.

However, the feed point and the variable capacity reactive element are arranged at both the ends of the circuit board, respectively, to achieve a function as one antenna; thus, the downsizing is not fully achieved.

Further, in the antenna apparatus of Patent document 1, the above-mentioned current loop is formed, thereby causing both the ground structure and the earth conductor to be radiation source. This requires the design to consider the both. Therefore, the design of the antenna apparatus may become complicated; the configuration of the antenna apparatus may become complicated.

SUMMARY

It is an object to provide an antenna apparatus to effectively achieve downsizing while suppressing complication in design and configuration.

To achieve the above object, according to an aspect of the present disclose, an antenna apparatus is provided to include a first earth plate and a radio frequency circuit board. In the radio frequency circuit board, (i) at least one radio frequency communication circuit that communicates a communication signal on radio waves and (ii) a second earth plate are formed. The radio frequency communication circuit includes at least one of (i) a radio frequency transmission circuit that transmits a transmission signal as the communication signal and (ii) a radio frequency reception circuit that receives a reception signal as the communication signal. The second earth plate serves as a grounding electric potential of the radio frequency communication circuit. The radio frequency circuit board is arranged such that a plate plane of the second earth plate intersects with a plate plane of the first earth plate. Herein, the first earth plate and the second earth plate are in electrical insulation state at least with respect to signals of frequencies of the communication signal; and a feed of the communication signal by the radio frequency communication circuit is executed by an unbalanced feed for each of the radio frequency communication circuit, while for the each of the radio frequency communication circuit, a feed line in the unbalanced feed is connected with the first earth plate and a ground line in the unbalanced feed is connected with the second earth plate.

The above configuration is characterized in that the feed line from the radio frequency communication circuit is connected with the first earth plate, whereas the ground line is connected with the second earth plate of the radio frequency circuit board. Thus, the first earth plate and the second earth plate are in the electrical insulation state.

Further, in the above configuration, the second earth plate of the radio frequency circuit board is floated against the first earth plate in respect of the radio frequency, and the feed from the feed line to the first earth plate causes the potential of the second earth plate of the radio frequency circuit board to change. This causes a vertical current to excite near the connection point of the ground line in the second earth plate. The exciting current enables a function as an antenna without need of providing an antenna element separately.

In addition, the second earth plate and the first earth plate are arranged such that both board planes intersect with each other; thus, a current component perpendicular (vertical) to the (horizontal) first earth plate is at least contained in the exciting current. This configuration enables communication of the radio wave or radio wave having the component of the (vertical) polarization wave. By virtue of this vertical current component, the antenna apparatus according to the aspect of the present disclosure is regarded as forming a vertical monopole using the second earth plate of the radio frequency circuit board.

Thus, the antenna apparatus has a simple configuration where the feed line from the radio frequency communication circuit is connected with the first earth plate, and the ground line is connected with the second earth plate of the radio frequency circuit board. This simple configuration enables communication of the vertical polarization wave without need of providing an antenna element separately. Therefore, the above configuration achieves downsizing effectively, while suppressing the complication in the design or configuration.

The radio frequency communication circuit may be one of several configurations. For example, it may include a circuit configuration to have a function of an analog signal process for communication signals such as an amplification and frequency conversion of communication signals.

In addition, the electrical insulation state includes not only a state where there is no electrical and physical connection, but also a state where a high impedance (equal to or greater than a predetermined impedance value) arises with respect to a frequency of a communication signal.

In addition, the arrangement relationship between the first earth plate and the second earth plate is defined as an intersecting angle formed by both the plates intersecting with each other. This intersecting angle may be within a range to enable communication of the radio wave of the (vertical) polarization wave component perpendicular (vertical) to the first earth plate (i.e., the vertical polarization wave component), for instance, providing the gain of the vertical polarization wave component as being greater than a desired level. A desirable arrangement relationship may be a state where the second earth plate is perpendicular or approximately perpendicular to the first earth plate.

BRIEF DESCRIPTION OF THE DRAWINGS

The above and other objects, features, and advantages of the present disclosure will become more apparent from the following detailed description made with reference to the accompanying drawings. In the drawings.

DETAILED DESCRIPTION

[First Embodiment]

Figure 1A:
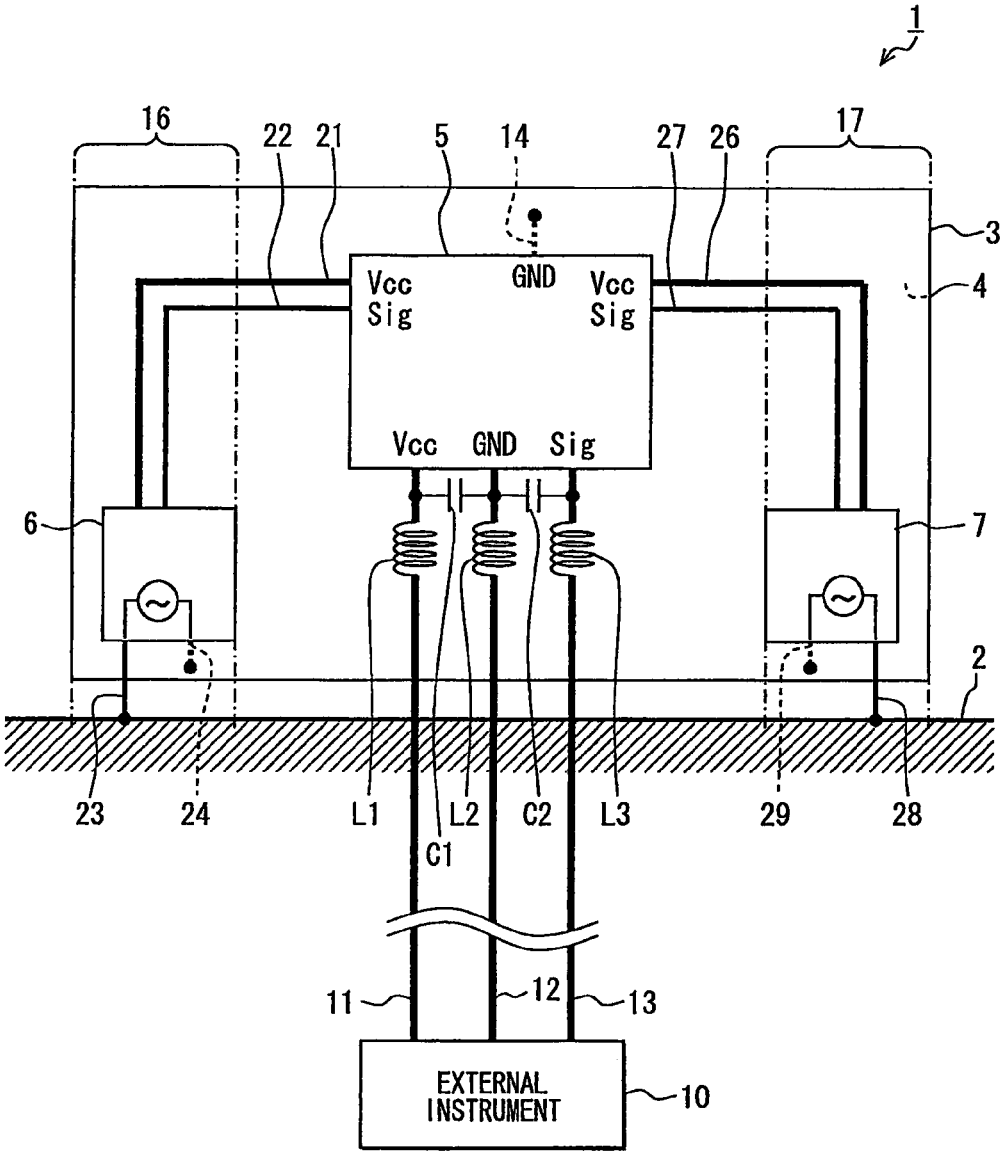
FIG. 1A is a diagram illustrating a schematic configuration of a wireless communication module according to a first embodiment.

A wireless communication module 1 is an embodiment to which the present disclosure applied. The module 1 is arranged on a roof of a vehicle (unshown) and used for wireless communications, such as GPS and vehicle-to-vehicle communications. As illustrated in FIG. 1A, the wireless communication module 1 includes a first earth plate 2 arranged to be fixed on the roof of the vehicle, and a radio frequency circuit board 3 arranged above the first earth plate 2.

The first earth plate 2 is a ground of the whole of the wireless communication module 1, and electrically connected with the roof (conductor) of the vehicle, providing a potential identical to that of a vehicle body serving as a conductor. The radio frequency circuit board 3 includes mainly a baseband circuit 5, a first radio frequency transmission and reception circuit 6, and a second radio frequency transmission and reception circuit 7. These circuits 5, 6, 7 are arranged on one side or surface of a dielectric substrate (board) included in the radio frequency circuit board 3. In contrast, a second earth plate 4 is arranged on the other side or surface of the dielectric substrate serving as the ground (grounding electric potential) of the above circuits 5, 6, 7. In the present application, the radio frequency transmission and reception circuit may be referred to as a radio frequency communication circuit that communicates a communication signal, and may function as at least one of (i) a radio frequency transmission circuit that transmits a transmission signal as a communication signal on radio waves and (ii) a radio frequency reception circuit that receives a reception signal as a communication signal on radio waves.

Figure 1B:
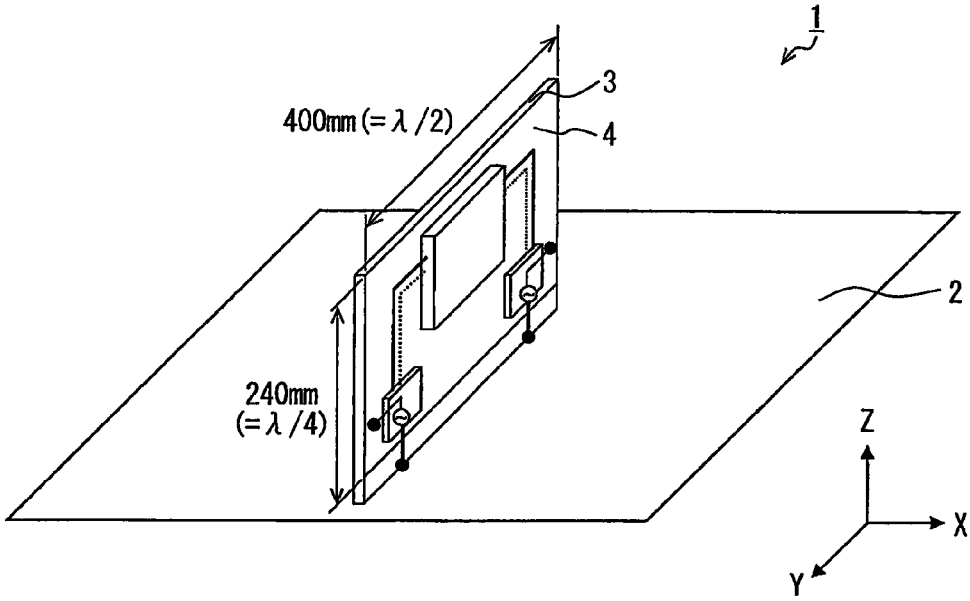
FIG. 1B is a diagram illustrating a perspective view of the wireless communication module according the first embodiment.

FIG. 1A illustrates a view of the one surface (front surface) of the radio frequency circuit board 3; therefore, the circuits 5, 6, 7 formed on the front surface are visibly illustrated. In contrast, although not visible in FIG. 1A, the second earth plate 4 made of a conductor is formed on the other surface (rear side). Further, FIG. 1B illustrates a perspective view of the wireless communication module 1.

The radio frequency circuit board 3 is arranged above the first earth plate 2 such that the board plane of the radio frequency circuit board 3 is perpendicular (i.e., vertical) to the board plane (i.e., the plate plane) of the first earth plate 2, namely, the board plane (i.e., the plate plane) of the second earth plate 4 of the radio frequency circuit board 3 is vertical to the board plane of the first earth plate 2. It is noted that although the radio frequency circuit board 3 may directly abut on the first earth plate 2 (refer to FIG. 1B), the second earth plate 4 does not directly abut on the first earth plate 2 and is arranged to be separated by a predetermined distance in a vertical direction from the first earth plate 2.

The first radio frequency transmission and reception circuit 6 and the second radio frequency transmission and reception circuit 7 are formed at both end portions in a horizontal direction of the radio frequency circuit board 3, respectively. It is noted that the horizontal direction is defined as being parallel with the board plane of the second earth plate 4 and simultaneously parallel with the board plane of the first earth plate 2.

That is, the first radio frequency transmission and reception circuit 6 is formed in a predetermined first end region 16 which contains one end (end on the left-hand side of FIG. 1A) among both the ends of the radio frequency circuit board 3. This first end region 16 is separated, towards the one end, more than a predetermined distance from the central position in the horizontal direction of the radio frequency circuit board 3. Further, the first end region 16 is defined as being containing (i) an on-board region of the radio frequency circuit board 3 and (ii) an extended region formed when the on-board region is virtually extended, downward in FIG. 1A, to reach the first earth plate 2.

Further, the second radio frequency transmission and reception circuit 7 is formed in a predetermined second end region 17 which contains the other end (end on the right-hand side of FIG. 1A) among both the ends of the radio frequency circuit board 3. This second end region 17 is separated, toward the other end, more than a predetermined distance from the central position in the horizontal direction of the radio frequency circuit board 3. Similarly to the first end region 16, the second end region 17 is defined as being containing (i) an on-board region of the radio frequency circuit board 3 and (ii) an extended region formed when the on-board region is virtually extended, downward in FIG. 1A, to reach the first earth plate 2.

Transmission and reception of radio waves or electric waves of the wireless communication module 1 are executed via the above first radio frequency transmission and reception circuit 6 and the second radio frequency transmission and reception circuit 7, each of which serves as a feed circuit. Herein, "feed" is used to be identical to an electricity feed of radio frequency. That is, the first radio frequency transmission and reception circuit 6 is provided such that the feed may be performed by unbalanced feed. A feed line 23 in the unbalanced feed is connected to the first earth plate 2; a ground line 24 is connected to the second earth plate 4 of the radio frequency circuit board 3.

It is noted that the vertical direction signifies a direction perpendicular to the board plane of the first earth plate 2, and simultaneously perpendicular to a road surface of a travel road on which the vehicle is or travels. Therefore, the second earth plate 4 of the radio frequency circuit board 3 is arranged perpendicularly (vertically) to the road surface of the travel road.

In the first radio frequency transmission and reception circuit 6, the ground line 24, and the second earth plate 4 are connected at a connection point (ground connection point), which is in the first end region 16. In addition, the feed line 23 and the first earth plate 2 are connected at a connection point (i.e., feed point), which is included in the first end region 16 in the horizontal direction, as illustrated in FIG. 1A.

This first radio frequency transmission and reception circuit 6 has a function as a so-called RF (Radio Frequency) circuit. The circuit 6 operates on a power source supplied by the first power line 21 from the baseband circuit 5; the circuit 6 applies modulation/frequency conversion to a transmission data transmitted via a first signal line 22 from the baseband circuit 5, outputting as a transmission signal to the feed line 23. Thus, the transmission signal is wirelessly transmitted on radio wave (or electric wave). In contrast, a reception signal is received by the first radio frequency transmission and reception circuit 6 on radio wave and demodulated by the first radio frequency transmission and reception circuit 6 into a reception data. The reception data is inputted into the baseband circuit 5 via the first signal line 22.

In the present embodiment, the feed line 23 is connected to the first earth plate 2, although in a usual antenna, a feed line is connected with an antenna element. This configuration produces a state where the second earth plate 4 of the radio frequency circuit board 3 is floated against the first earth plate 2 in respect of a radio frequency; a potential of the second earth plate 4 of the radio frequency circuit board 3 is varied by the feed from the feed line 23 to the first earth plate 2. This causes a vertical current to excite near the connection point of the ground line 24 in the second earth plate 4. This exciting current enables a function as an antenna without need of providing an antenna element separately.

The exciting current is mainly a vertical current component; thus, radio wave or electric wave of vertical polarization wave can be transmitted and received favorably. That is, the wireless communication module 1 of the present embodiment may be regarded as forming a vertical monopole using the second earth plate 4 of the radio frequency circuit board 3. It is noted that not only the vertical current component but also horizontal or oblique current component may be excited. Therefore, the radio wave of not only vertical polarization wave but also horizontal or oblique polarization wave can be transmitted and received.

The second radio frequency transmission and reception circuit 7 has a configuration comparable with that of the first radio frequency transmission and reception circuit 6. The circuit 7 has a function as a so-called RF circuit. The circuit 7 operates on the power source supplied by a second power line 26 from the baseband circuit 5, and applies modulation/frequency conversion to a transmission data transmitted via a second signal line 27 from the baseband circuit 5, outputting as a transmission signal to the feed line 28. Thus, the transmission signal is wirelessly transmitted on electric wave (or radio wave). In contrast, a reception signal is received by the second radio frequency transmission and reception circuit 7 on radio wave and demodulated by the first radio frequency transmission and reception circuit 7 to a reception data. The reception data is inputted into the baseband circuit 5 via the second signal line 27.

Figure 2:
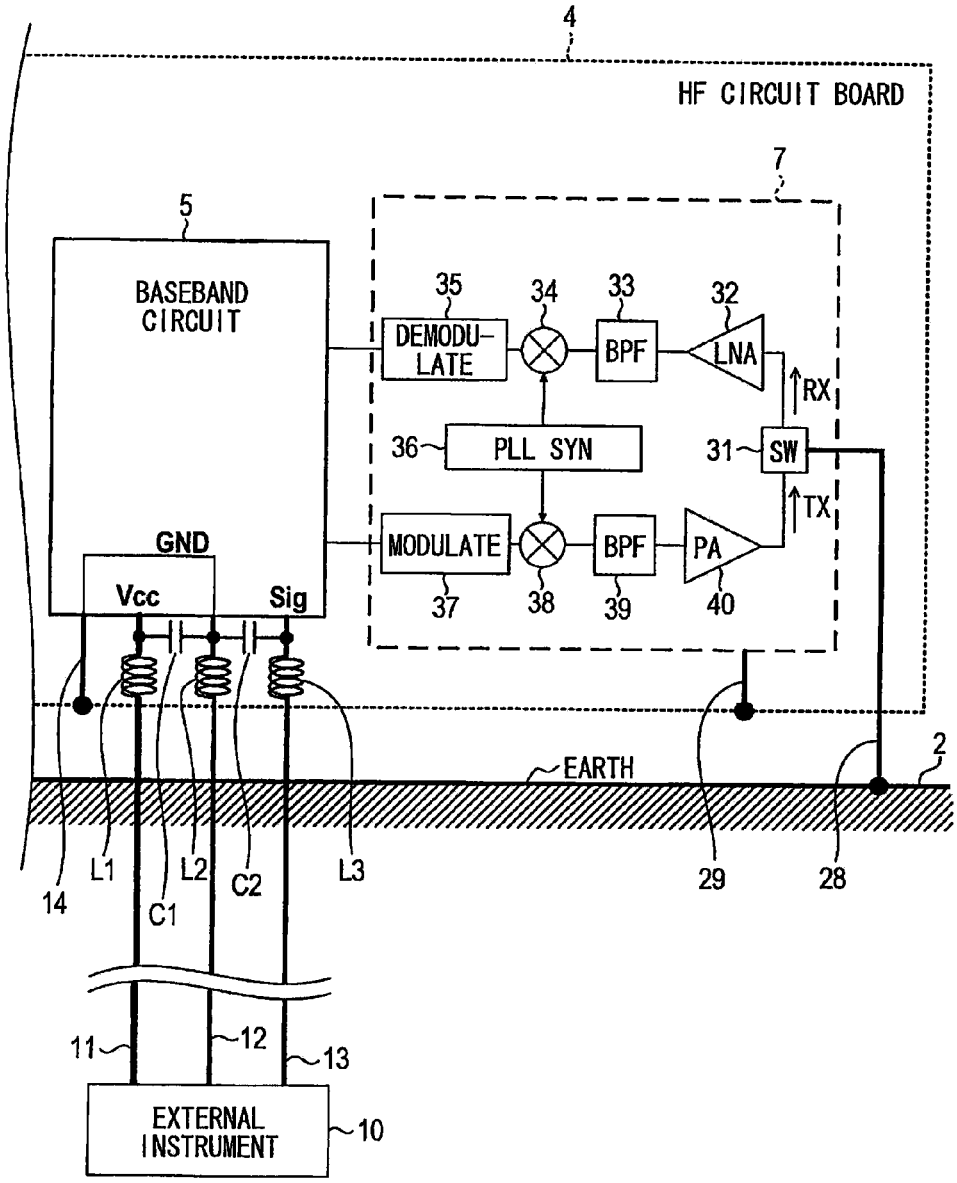
FIG. 2 is a diagram illustrating a configuration of a radio frequency transmission and reception circuit in the wireless communication module.

The internal configuration of this second radio frequency transmission and reception circuit 7 is illustrated in FIG. 2. The circuit 7 includes the following: an antenna switch 31 for switching the feed line 28 to one of the transmitting side or the receiving side; a low noise amplifier (LNA) 32 which amplifies a reception signal (RX); a band pass filter (BPF) 33 which extracts a predetermined operating frequency component from the reception signal after the amplification, wherein the operating frequency component is a component of a frequency band occupied by transmission and reception signals transmitted and received on radio waves; a frequency converter 34 which carries out frequency conversion (down convert) of the reception signal which passed the BPF 33 to a predetermined intermediate frequency lower than the frequency of the reception signal; a demodulator 35 which demodulates the reception signal after the down convert, and outputs a reception data (baseband signal); a modulator 37 which modulates a transmission data (baseband signal) inputted from the baseband circuit 5 to a transmission signal of the above intermediate frequency; a frequency converter 38 which carries out frequency conversion (up convert) to the transmission signal of a predetermined operating frequency of radio waves on which the modulated transmission signal is transmitted; a BPF 39 which extracts the above operating frequency component from the transmission signal after the up convert; a power amplifier (PA) 40 which amplifies the transmission signal which passed the BPF 39; and a PLL (Phase Locked Loop) synthesizer 36 which generates a local frequency signal used for the frequency conversion in each frequency converter 34, 38.

As explained in the above, the feed line 28 connected to the antenna switch 31 is connected to the first earth plate 2; the ground line 29 of the second radio frequency transmission and reception circuit 7 is connected to the second earth plain 4 of the radio frequency circuit board 3.

Further, the internal configuration of the first radio frequency transmission and reception circuit 6 is identical to that of the second radio frequency transmission and reception circuit 7 illustrated in FIG. 2. With reference to FIG. 1A, again, the baseband circuit 5 is connected with an external instrument 10 via an external power line 11, an external ground line 12, and an external signal line 13. The external instrument includes a navigation ECU to control wireless communication module 1.

The external power line 11 supplies a power source for operating the circuits 5, 6, 7 in the radio frequency circuit board 3. The power source for operating is supplied via the external power line 11 from the external instrument 10. The power source for operating is a DC power supply in the present embodiment. In detail, the external power line 11 is connected to the baseband circuit 5 in the radio frequency circuit board 3, and the DC power supply is inputted into this baseband circuit 5. The inputted DC power supply is used as the power source for operating the baseband circuit 5, and further inputted into the two radio frequency transmission and reception circuits 6, 7 via the power lines 21, 26 from the baseband circuit 5 for use as a power source for operating the radio frequency transmission and reception circuits 6, 7, respectively. In addition, the external signal line 13 transmits data (transmission data, reception data) which is transmitted and received by the first radio frequency transmission and reception circuit 6 and the second radio frequency transmission and reception circuit 7. That is, the transmission data transmitted from the external instrument 10 undergoes a predetermined process in the baseband circuit 5 and then outputted to each of the radio frequency transmission and reception circuits 6, 7 via each signal line 22, 27. Thereby, the transmission data undergoes the modulation/frequency conversion in each radio frequency transmission and reception circuit 6, 7, and transmitted via each feed line 23, 28 as radio waves.

In contrast, the reception signal is received as radio waves and inputted into each radio frequency transmission and reception circuit 6, 7. Then, the reception signal undergoes frequency conversion/demodulating, etc., in each radio frequency transmission and reception circuit 6, 7, and becomes a reception data (baseband signal). The reception data is inputted into the baseband circuit 5 via the signal lines 22, 27. Further, the inputted reception data undergoes a predetermined process (e.g., a process by a maximum ratio synthetic method) in the baseband circuit 5, and transmitted to the external instrument 10 via the external signal line 13.

The maximum ratio synthetic method matches the phases of the reception signals from the radio frequency transmission and reception circuits 6, 7 with each other, and applies weighting synthesis to the reception signals according to the strengths to the reception signals. It is well known as one of techniques for specifically realizing spacial diversity. In addition, the several transmission and reception circuits are provided, thereby responding to a wireless communication system using several antennas such as a spacial diversity or MIMO (Multiple-Input and Multiple-Output). As illustrated in FIGS. 1, 2, the external instrument 10 is connected to a ground; in the radio frequency circuit board 3, the baseband circuit 5 is connected to the second earth plate 4 of the radio frequency circuit board 3 via a ground connection line 14. That is, the ground of the external instrument 10 and the second earth plate 4 of the radio frequency circuit board 3 are in the state where they are electrically connected via the external ground line 12. The ground of the external instrument 10 is connected with the first earth plate 2 (unshown); thus, the second earth plate 4 and the first earth plate 2 of the radio frequency circuit board 3 are electrically connected.

It is noted that, as illustrated in FIG. 1A, in the wireless communication module 1, the external ground line 12 is connected in series with a coil L2 as an impedance component near a connection point with the baseband circuit 5. This coil L2 has a high inductance value that produces a sufficiently high impedance equal to or greater than a predetermined impedance in the frequency band (in the radio frequency range) occupied by the transmission and reception signals transmitted and received on radio waves via the radio frequency transmission and reception circuits 6, 7.

Therefore, the second earth plate 4 and the ground of the external instrument 10 (i.e., the second earth plain 4 and the first earth plain 2) are insulated from each other in the radio frequency range. In contrast, they are in the state equivalent to the conductive state in direct current; namely, the coil L2 provides a predetermined low impedance value lower than the above high impedance value in the direct current.

In addition, under the present embodiment, in the wireless communication module 1, a bypass capacitor C1 is connected in between external ground line 12 and the external power line 11; a bypass capacitor C2 is connected in between external ground line 12 and the external signal line 13. Therefore, impedance components are connected in series with the external power line 11 and the external signal line 13, respectively, similar to the external ground line 12. That is, a coil L1 is connected in series with the external power line 11; a coil L3 is connected in series with the external signal line 13. Thus, the impedance component is provided to each of other lines connected with the external ground line 12 using the bypass capacitors. This configuration maintains more certainly the insulation state between the first earth plate 2 and the second earth plate 4 of the radio frequency circuit board 3.

Figure 3A:
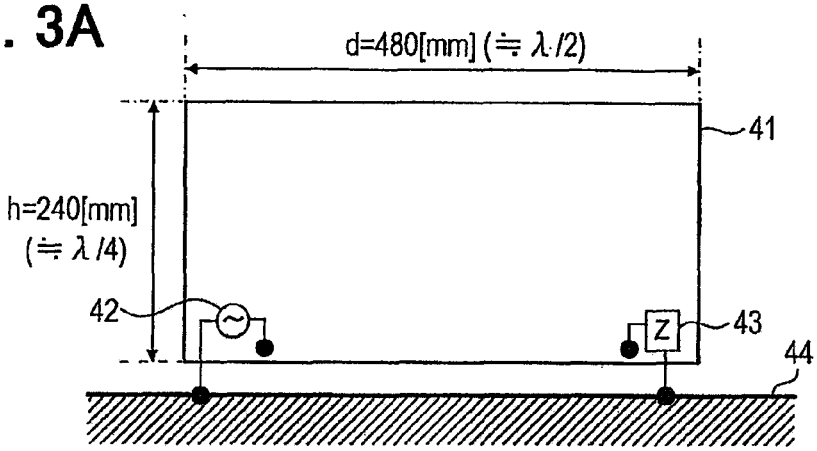
FIGS. 3A to 3C are diagrams for explaining a characteristic (directionality and VSWR) of an antenna included in the wireless communication module.
Figure 3B:
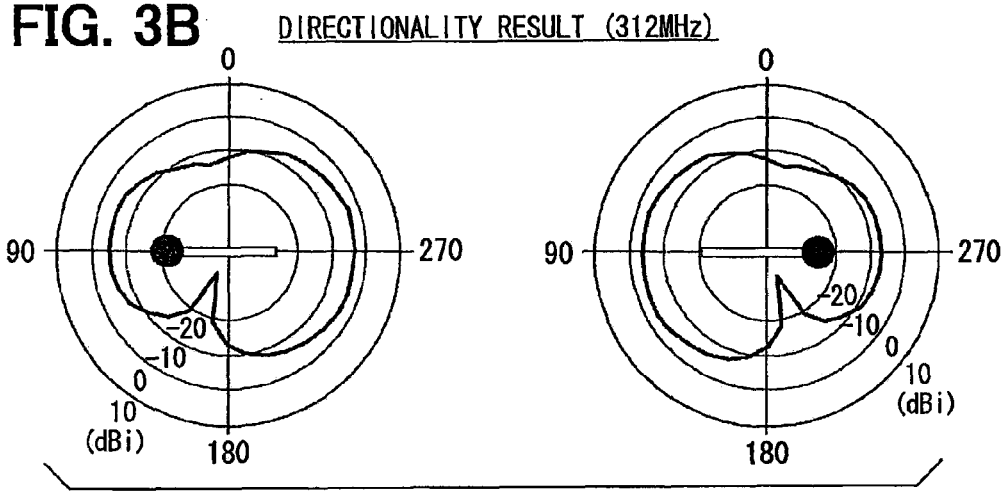
Figure 3C:
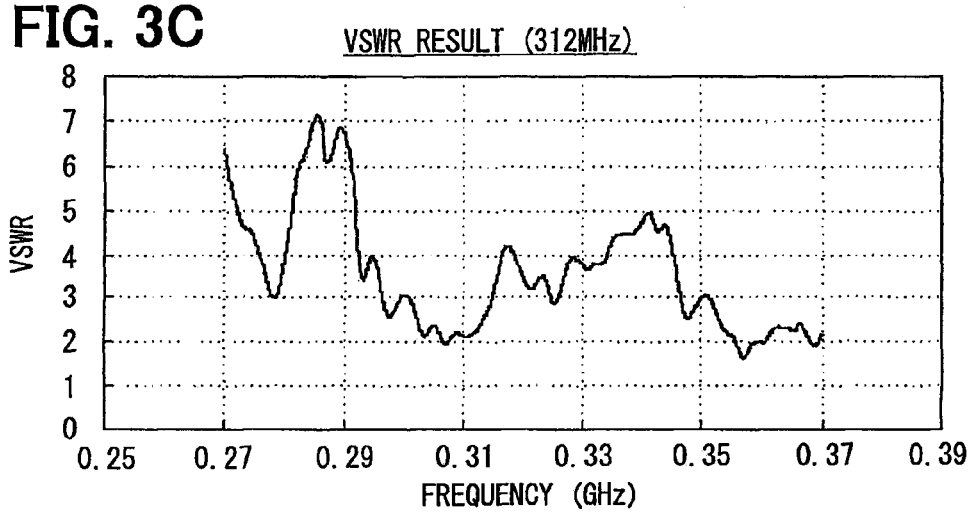

The following will explain an example of a characteristic as an antenna of the wireless communication module 1 of the present embodiment with reference to FIGS. 3A to 3C. FIG. 3A illustrates a model for measuring a directional characteristic and VSWR (Voltage Standing Wave Ratio) of the wireless communication module 1 of the present embodiment. In the model, the second earth plate 41 is arranged to stand vertically above the first earth plate 44; the second earth plate 41 has a feed circuit 42 in one end portion. This model assumes a selective spacial diversity, where an antenna in only one end portion functions. Therefore, the other end portion of the second earth plate 41 is connected with a 50-ohm termination resistor 43. In addition, the frequency of the use radio wave is designated as 312 MHz. The second earth plate 41 has a width d (i.e., a length in a horizontal direction of the substrate) of 480 mm which is about ½ of the wavelength of the use radio wave; the second earth plate 41 has a height d (i.e., a length in a vertical direction of the substrate) of 240 mm which is about ¼ of the wavelength of the use radio wave.

FIG. 3B illustrates a result of measuring a directionality (horizontal plane directionality to vertical polarization wave component) of the antenna apparatus of the model. In addition, FIG. 3C illustrates a result of measuring a VSWR. Two directional characteristics in FIG. 3B are obtained by counterchanging between the position of the feed circuit 42 and the position of the termination resistor 43 in the second earth plate 41.

As illustrated in FIG. 3B, although a null point occurs in a certain direction, the model provides a favorable directional characteristic. Therefore, the second earth plate 41 is provided with two feed circuits in both the end portions; namely, the wireless communication module 1 has a configuration illustrated in FIG. 1A. This configuration can demonstrate a favorable spacial diversity.

In addition, the measuring result of the VSWR illustrated in FIG. 3C indicates that the VSWR is 3 or less at about 312 MHz serving as the use frequency, providing a favorable performance. This also indicates that the performance as an antenna of the wireless communication module 1 of the present embodiment is favorable.

Figure 4:
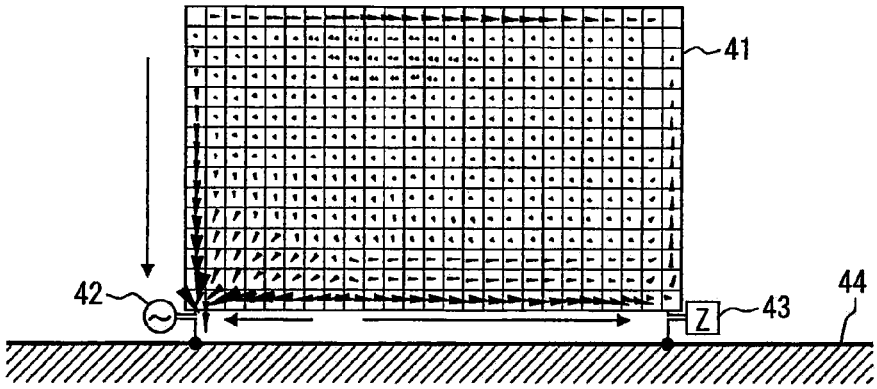
FIG. 4 is a diagram for explaining an antenna characteristic (current distribution) in the wireless communication module.

FIG. 4 illustrates a simulation result of the current distribution in the model illustrated in FIG. 3A. FIG. 4 indicates that a strong vertical current component and a strong horizontal current component occur in the end portion in which the feed circuit 42 is located. This simulation result proves that the present antenna apparatus (wireless communication module 1) can desirably transmit and receive both the two polarization wave components of the vertical polarization wave and the horizontal polarization wave.

As explained above, the wireless communication module 1 of the present embodiment provides a simple configuration where the feed lines 23, 28 from the radio frequency transmission and reception circuits 6, 7 are connected with the first earth plate 2, whereas the ground lines 24, 29 are connected with the second earth plate 4 of the radio frequency circuit board 3. Such a simple configuration can achieve a vertically polarized wave monopole without providing any antenna element separately, enabling the vertical polarization wave to be transmitted and received desirably. Therefore, the above configuration achieves downsizing of the whole of the wireless communication module 1 effectively, while suppressing the complication in the design or configuration. Furthermore, the radio waves of not only vertical polarization wave component but also horizontal or oblique polarization wave component can be transmitted and received.

In addition, the two radio frequency transmission and reception circuits 6, 7 are arranged in both the end portions of the radio frequency circuit board 3, respectively, and are supplied with the feed at both the end portions, respectively. Thus, the interval between them (in detail, the interval of both the ground connection points) may be changed as needed, thereby responding to a wireless communication system using several antennas such as a spacial diversity or MIMO (Multiple-Input and Multiple-Output). Therefore, the above configuration realizes coexistence of two of (i) the miniaturization of the whole module and (ii) the favorable communication performance which can respond to mobile communications or multi-path fading.

Furthermore, the radio frequency circuit board 3 is physically (i.e., mechanically) connected with the external ground line 12, whereas the external ground line 12 is connected in series with the impedance component (coil L2). Therefore, the radio frequency circuit board 3 and the ground of the external instrument 10 are in the electrical continuity in direct current, whereas they are maintained, in the radio frequency range, in the electrical insulation state due to the high impedance. Furthermore, impedance components are connected in series with the external power line 11 and the external signal line 13, respectively, similar to the external ground line 12. Such a configuration can easily and certainly achieve the electrical insulation in the radio frequency range between the radio frequency circuit board 3 and the ground of the external instrument 10 (as a result, the electrical insulation in the radio frequency range between the second earth plate 4 of the radio frequency circuit board 3 and the first earth plate 2).

[Modification]

Although the embodiment is described above, the present disclosure is not limited to the embodiment and can be modified in various manners within a technical scope of the present disclosure.

Figure 5:
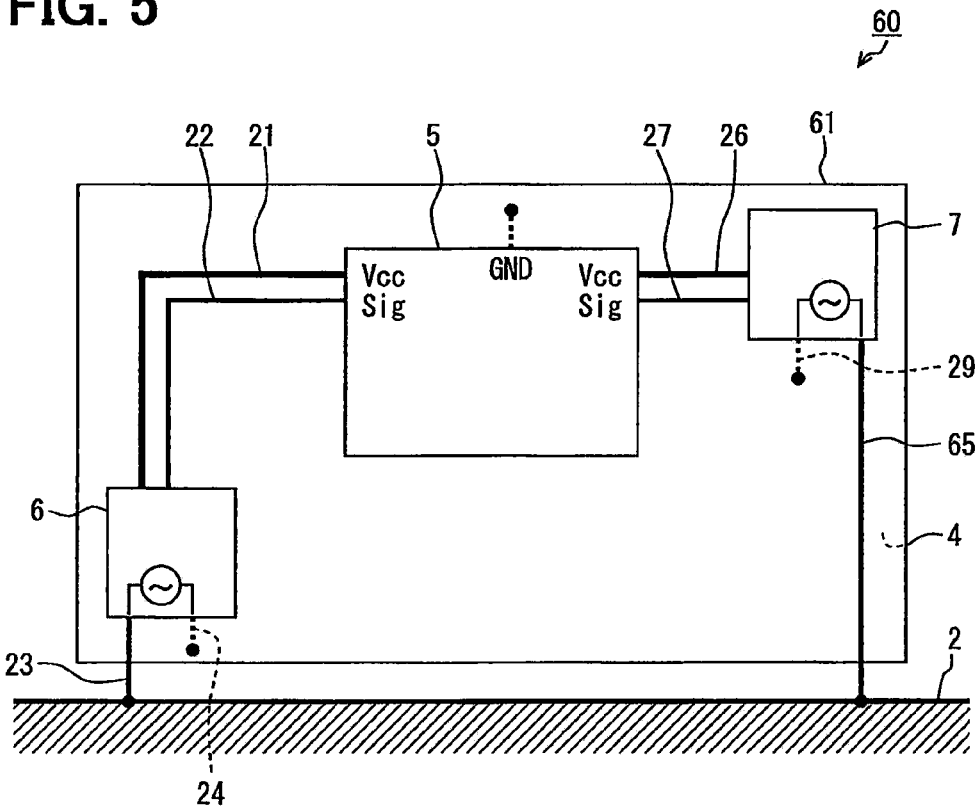
FIG. 5 is a diagram illustrating another configuration of the wireless communication module.

For example, there may be a variety of arrangements of the several radio frequency transmission and reception circuits in the radio frequency circuit board. For example, with reference to FIG. 5, a wireless communication module 60 has a configuration where the first radio frequency transmission and reception circuit 6 is arranged in one of both the end portions in a radio frequency circuit board 61, like in FIG. 1A, whereas the second radio frequency transmission and reception circuit 7 is arranged in an vertically upper portion of the other of both the end portions in the radio frequency circuit board 61. In this case, a feed line 65 from the second radio frequency transmission and reception circuit 7 may be arranged in any one of various positions as needed. For example, the feed line 65 may be provided using a micro stripe on the circuit board 61.

Figure 6:
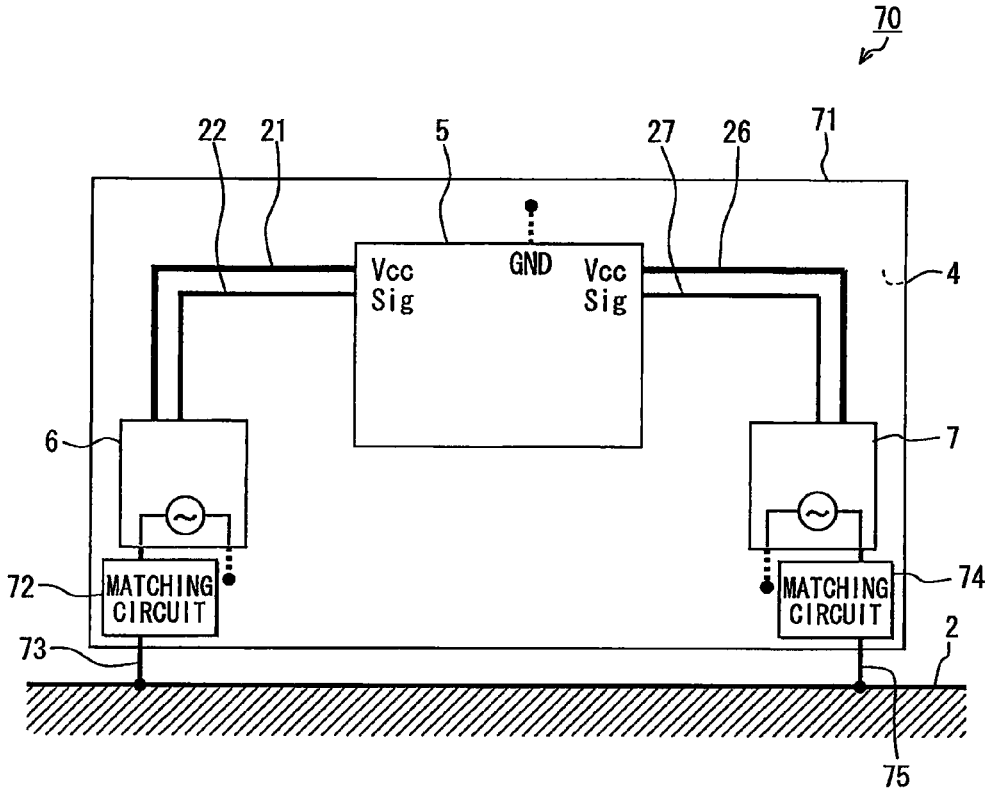
FIG. 6 is a diagram illustrating another configuration of the wireless communication module.

In addition, suppose a case where an output impedance from the radio frequency transmission and reception circuit cannot be adjusted appropriately. In such a case, as illustrated in FIG. 6, matching circuits 72, 74 are provided in the feed lines from the radio frequency transmission and reception circuits 6, 7, respectively; thereby, the impedance matching can be achieved. That is, the feed lines 73, 75 are connected to the first earth plate 2 via the matching circuits 72, 74, respectively.

Further, in the above embodiment, a baseband signal is transmitted between the baseband circuit 5 and each of the radio frequency transmission and reception circuits 6, 7; the radio frequency transmission and reception circuits 6, 7 modulate a transmission data and demodulate a reception data. Such circuit arrangement is just only an example. For example, the modulator 37 and the demodulator 35 may be arranged out of the radio frequency transmission and reception circuits 6, 7. Naturally, the modulator 37 and the demodulator 35 may be arranged in the baseband circuit 5.

In addition, the above embodiment has a configuration where the baseband circuit 5 and the two radio frequency transmission and reception circuits 6, 7 are formed in the radio frequency circuit board 3. The configuration of the above embodiment is just only an example. What a kind of a circuit or the like formed in the radio frequency circuit board 3 may be determined as needed. For example, the baseband circuit 5 may be provided to be separated from the radio frequency circuit board 3. In addition, in such a case, the configuration of the radio frequency transmission and reception circuits 6, 7 formed in the radio frequency circuit board 3 may be also considered as needed. For example, the modulator 35 and the demodulator 37 may be provided to be separated from the radio frequency circuit board 3, like the baseband circuit 5.

Further, in the above embodiment, the bypass capacitor C1 is connected in between external ground line 12 and the external power line 11; the bypass capacitor C2 is connected in between external ground line 12 and the external signal line 13. Therefore, the impedance components (coils in the above embodiment) are arranged in series in the lines 11, 12, 13. However, the configuration where the impedance components are connected, respectively, to the external power line 11, the external ground line 12, and the external signal line 13 is just only an example. For example, when the bypass capacitor C2 is not connected between the external ground line 12 and the external signal line 13, the connection of the coil L3 to the external signal line 13 is not indispensable.

In addition, for securing the electrical insulation between the first earth plate 2 and the second earth plate 4 in the radio frequency range, the configuration is adopted which connects the coil L1, L2, L3. However, such a configuration is just only an example. As long as the electrical insulation in the radio frequency range is securable in between the first earth plate 2 and the second earth plate 4, how to is specifically realize it can be determined suitably.

In addition, the above embodiment has a configuration where the radio frequency transmission and reception circuits 6, 7 are formed in both the end portions of the substrate, respectively. Without need to be limited thereto, a wireless communication module may contain only one radio frequency transmission and reception circuit or more than two radio frequency transmission and reception circuits.

In addition, the above embodiment has a configuration where the board plane of the second earth plate 4 of the radio frequency circuit board 3 is perpendicular to the board plane of the first earth plate 2. However, the angle of the board plane of the second earth plate 4 to the board plane of the first earth plate 2 need not be always a right angle or perpendicular. What is necessary is just an arrangement relationship that both board planes intersect with each other; namely, two board planes intersect with each other with a predetermined intersecting angle. As long as such an arrangement relationship is secured, transmission and reception of the vertical polarization wave are possible. In addition, as long as the desired performance serving as the wireless communication module is achieved, the above intersecting angle may be determined suitably. The desired performance signifies that the vertical polarization wave component can be transmitted and received desirably (for example, the gain on the vertical polarization wave becomes greater than a desired level).

It is noted that in order to obtain effectively the desirable performance relative to the vertical polarization wave in respect of designing and manufacturing an antenna, the arrangement relationship of forming a perpendicular state or an approximately perpendicular state is desirable.

While the present disclosure has been described with reference to preferred embodiments thereof, it is to be understood that the disclosure is not limited to the preferred embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

What is claimed is:

1. An antenna apparatus comprising:

a first earth plate; and a radio frequency circuit board in which (i) at least one radio frequency communication circuit that communicates a communication signal on radio waves and (ii) a second earth plate are formed, the radio frequency communication circuit including at least one of (i) a radio frequency transmission circuit that transmits a transmission signal as the communication signal and (ii) a radio frequency reception circuit that receives a reception signal as the communication signal, the second earth plate serving as a grounding electric potential of the radio frequency communication circuit, the radio frequency circuit board being arranged such that a plate plane of the second earth plate intersects with a plate plane of the first earth plate, wherein:

the first earth plate and the second earth plate are in electrical insulation state at least with respect to signals of frequencies of the communication signal; and a feed of the communication signal by the radio frequency communication circuit is executed by an unbalanced feed for each of the radio frequency communication circuit, while for the each of the radio frequency communication circuit, a feed line in the unbalanced feed is connected with the first earth plate and a ground line in the unbalanced feed is connected with the second earth plate.

2. The antenna apparatus according to claim 1, wherein:

the radio frequency circuit board includes a plurality of the radio frequency communication circuits;

for each of the radio frequency communication circuits, a feed point is provided as a connection point between the feed line and the first earth plate, whereas a ground connection point is provided as a connection point between the ground line and the second earth plate; and the feed points of the plurality of the radio frequency communication circuits are arranged in a direction that is parallel with the plate plane of the first earth plate and parallel with the plate plane of the second earth plate while being separated from each other in a horizontal direction of the plate plane of the second earth plate, and, similarly, the ground connection points of the plurality of the radio frequency communication circuits are arranged in a direction that is parallel with the plate plane of the first earth plate and parallel with the plate plane of the second earth plate while being separated from each other in a horizontal direction of the plate plane of the second earth plate.

3. The antenna apparatus according to claim 2, wherein:

the radio frequency circuit board include at least two radio frequency communication circuits;

one of the two ground connection points of the two radio frequency communication circuits is arranged in a predetermined first end region which contains one end of both ends in the horizontal direction of the radio frequency circuit board; and an other of the two ground connection points is arranged in a predetermined second end region that contains an other end of the both ends in the horizontal direction of the radio frequency circuit board.

4. The antenna apparatus according to claim 1, wherein the radio frequency circuit board is connected with an external power line for supplying an operating power of the radio frequency communication circuit from an external instrument, and an external ground line that is connected with a ground of the external instrument, the antenna further comprising:

an impedance component connected in series with the external ground line in order to achieve the electrical insulation state, the impedance component providing an impedance to a signal of a frequency of the communication signal as being equal to or greater than a predetermined high impedance value and an impedance to direct current as being smaller than a predetermined low impedance value that is less than the predetermined high impedance value.

5. The antenna apparatus according to claim 1, wherein:

the radio frequency circuit board is connected with an external power line, an external ground line, and an external signal line, the external power line being for supplying an operating power of the radio frequency communication circuit from an external instrument, the external ground line being connected with a ground of the external instrument, the external signal line communicating data with the external instrument; and an impedance component is provided in each of the external ground line, the external power line, and the external signal line.

6. The antenna apparatus according to claim 1, wherein:

the radio frequency circuit board is connected with an external power line, an external ground line, and an external signal line, the external power line being for supplying an operating power of the radio frequency communication circuit from an external instrument, the external ground line being connected with a ground of the external instrument, the external signal line communicating data with the external instrument; and a bypass capacitor is connected in between the external power line and the external ground line, whereas a bypass capacitor is connected in between the external ground line and the external signal line.

* * * * *